US006180842B1

(12) United States Patent
Berlowitz et al.

(10) Patent No.: US 6,180,842 B1
(45) Date of Patent: Jan. 30, 2001

(54) STABILITY FISCHER-TROPSCH DIESEL FUEL AND A PROCESS FOR ITS PRODUCTION

(75) Inventors: Paul J Berlowitz, E. Windsor, NJ (US); Robert J. Wittenbrink, Baton Rouge, LA (US); Bruce R. Cook, Pittstown, NJ (US)

(73) Assignee: Exxon Research and Engineering Company, Florham Park, NJ (US)

( * ) Notice: Under 35 U.S.C. 154(b), the term of this patent shall be extended for 0 days.

(21) Appl. No.: 09/138,130

(22) Filed: Aug. 21, 1998

(51) Int. Cl.[7] ..... C10L 1/16
(52) U.S. Cl. ..... 585/1; 585/14; 208/27
(58) Field of Search ..... 585/1, 14; 208/27

(56) References Cited

U.S. PATENT DOCUMENTS 4,125,566 * 11/1978 Dinh et al. ..... 208/17
4,568,663 * 2/1986 Mauldin ..... 585/733
4,846,959 * 7/1989 Kennedy et al. ..... 208/28
4,919,786 * 4/1990 Hammer et al. ..... 208/27
4,943,672 * 7/1990 Hammer et al. ..... 208/27
4,992,159 * 2/1991 Cody et al. ..... 208/27
5,151,172 * 9/1992 Kukes et al. ..... 208/144
5,348,982 * 9/1994 Herbalzheimer et al. ..... 518/700
5,378,348 * 1/1995 Davis et al. ..... 208/27
5,545,674 * 8/1996 Behrmann et al. ..... 518/715
5,689,031 * 11/1997 Berlowitz et al. ..... 585/734

FOREIGN PATENT DOCUMENTS 9626994 9/1996 (WO) ..... C10L/1/08
9714769 4/1997 (WO) ..... C10L/1/02
9834998 8/1998 (WO) ..... C10L/1/08

* cited by examiner

*Primary Examiner*—Margaret Medley
(74) *Attorney, Agent, or Firm*—Jay Simon

(57) ABSTRACT

A Fischer-Tropsch derived distillate fraction is blended with either a raw virgin condensate fraction or a mildly hydrotreated virgin condensate to obtain a stable inhibited distillate fuel.

6 Claims, 2 Drawing Sheets

STABILITY FISCHER-TROPSCH DIESEL FUEL AND A PROCESS FOR ITS PRODUCTION

FIELD OF THE INVENTION

This invention relates to stable, inhibited middle distillates and their preparation. More particularly, this invention relates to stable, inhibited middle distillates, useful as fuels e.g., kerosene, diesel, or as fuel blending components, in which a Fischer-Tropsch derived distillate is blended with a virgin distillate.

BACKGROUND OF THE INVENTION

Distillate fuels derived from Fischer-Tropsch processes are often hydrotreated to eliminate unsaturated materials, e.g., olefins, and most, if not all, oxygenates. The hydrotreating step is often combined with mild hydroisomerization resulting in the formation of iso-paraffins, often necessary for meeting pour point specifications for distillate fuels, particularly fuels heavier than gasoline, e.g., diesel and jet fuels.

Fischer-Tropsch distillates, by their nature, have essentially nil sulfur and nitrogen, these elements having been removed upstream of the Fischer-Tropsch reaction because they are poisons, even in rather small amounts, for known Fischer-Tropsch catalysts. As a consequence, Fischer-Tropsch derived distillate fuels are inherently stable, the compounds that may lead to instability, e.g., by oxidation, having been removed either upstream of the reaction or downstream in subsequent hydrotreating steps. While stable, these distillates have no inherent inhibitors for maintaining oxidative stability. Thus, upon the onset of oxidation, as in the formation of peroxides, a measure of oxidative stability, the distillate has no inherent mechanism for inhibiting oxidation. These materials may be viewed as having a relatively long induction period for oxidation, but upon initiation of oxidation, the material efficiently propagates oxidation.

Virgin distillates as may be obtained from conventional petroleum sources are usually a constituent of distillate fuels, and contain sulfur in varying concentrations. The addition, usually small amounts, of virgin distillate to Fischer-Tropsch distillates provides a facile method for stabilizing Fischer-Tropsch derived fuels against oxidation.

SUMMARY OF THE INVENTION

In accordance with this invention, a blended middle distillate, useful as a fuel or a fuel blending component, and having both stability and resistance to oxidation comprises: a Fischer-Tropsch (F-T) derived distillate and a virgin distillate fraction, and wherein the sulfur content of the blend is $\geqq 1$ ppm by wt.

Figure 1:
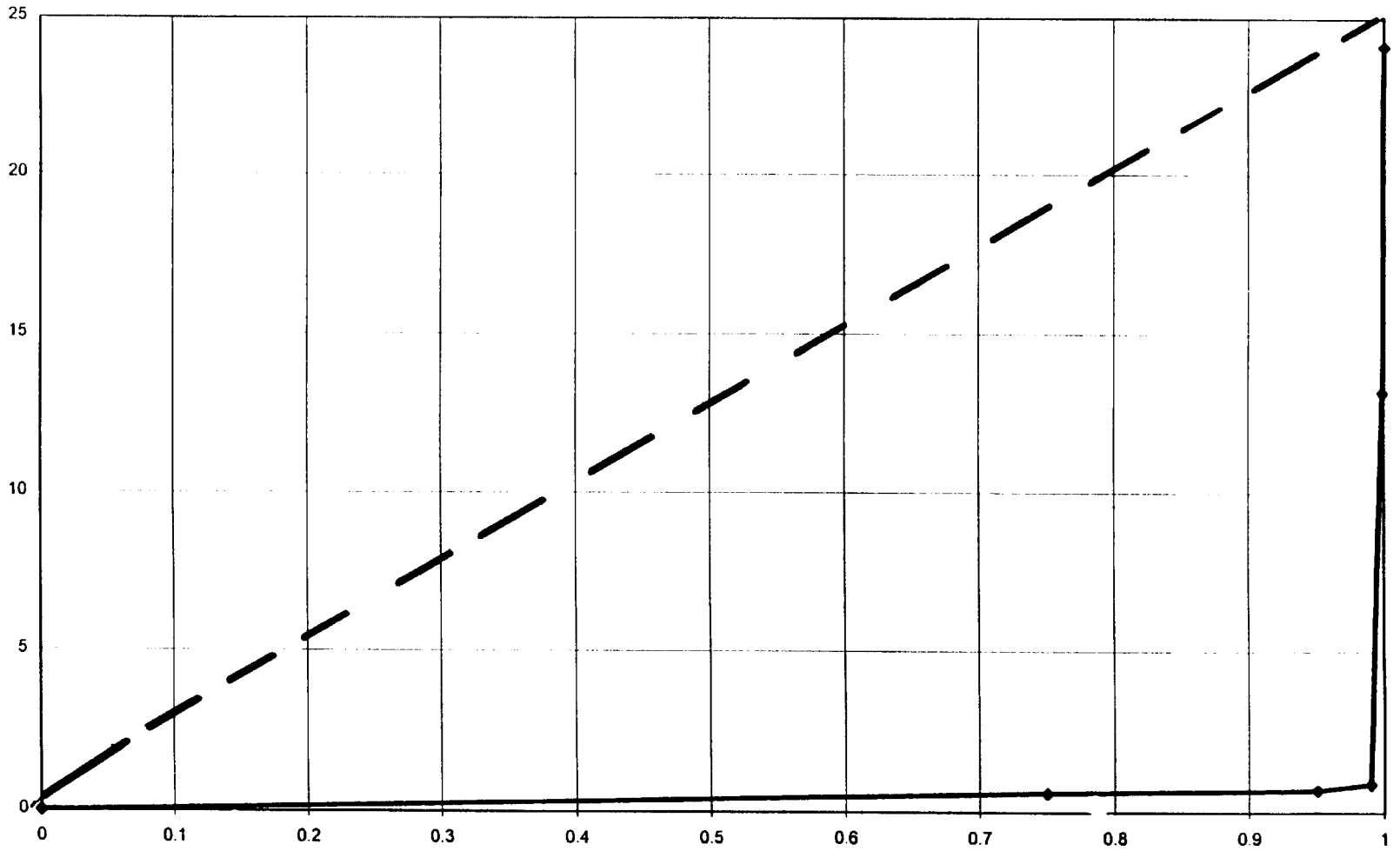
FIG. 1 shows the effect on peroxide number of adding 1%, 5%, and 25% by weight of a virgin distillate to a Fischer-Tropsch derived distillate fuel.
Figure 2:
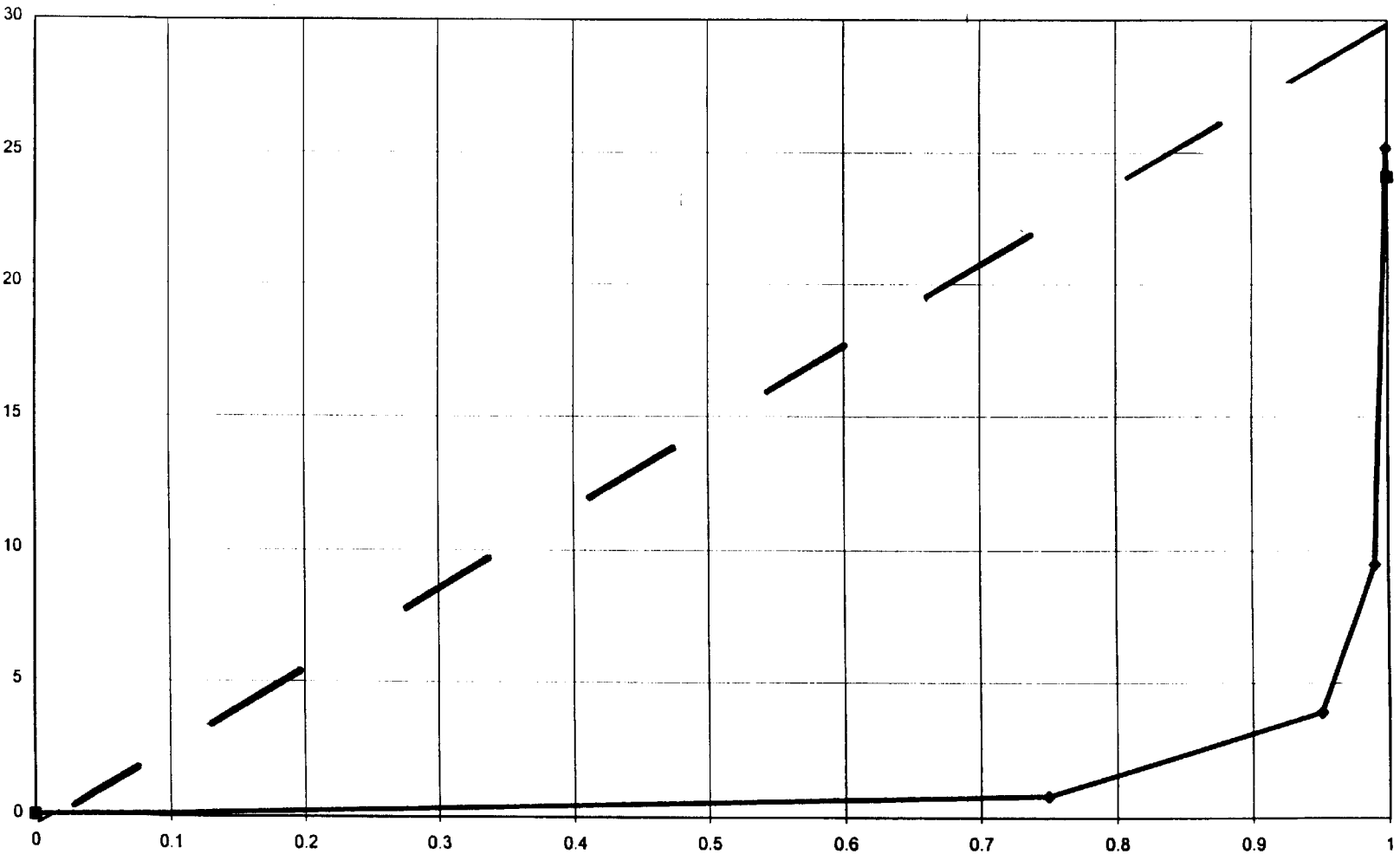
FIG. 2 shows the effect on peroxide number of adding a mildly hydrotreated virgin distillate having 210 ppm sulfur in amounts of 0.1, 0.5, 5.0, and 25% by weight to a Fischer-Tropsch derived fuel.

In each figure the peroxide number after 28 days is shown on the ordinate and the weight fraction Fischer-Tropsch derived fuel is shown on the abscissa.

In the absence of any known effects on the addition of a relatively less stable fuel with a relatively more stable, but uninhibited fuel, one would expect the peroxide number to fall on a straight line connecting the peroxide numbers for a 100% F-T derived fuel and a 100% virgin distillate fuel, shown in the drawings as a dotted line.

The data in the drawings make it abundantly clear that small amounts of virgin distillate, when added to a Fischer-Tropsch derived fuel can, and do, have a significant effect on the long term stability of the F-T derived fuel.

The distillate fraction for either the Fischer-Tropsch derived material or the gas field condensate is a $C_8$–700° F. stream, preferably comprised of a 250–700° F. fraction, and preferably in the case of diesel fuels or diesel range fuels, a 320–700° F. fraction.

The virgin distillate is preferably a distillate fraction that is essentially untreated, or stated otherwise, is in the substantial absence of any treatment materially changing the boiling point of the hydrocarbon liquids in the virgin distillate. Thus, the distillate has not been subjected to conversion by means that may significantly or materially change the boiling point of the liquid hydrocarbons in the virgin distillate. The virgin distillate, however, may have been de-watered, desalted, distilled to the proper fraction, or mildly hydrotreated, none of which significantly effects the boiling point of the liquid hydrocarbons of the virgin distillate.

In one embodiment, the virgin distillate may be subjected to hydrotreating, e.g., mild hydrotreating, that reduces sulfur content and olefinic content, but does not significantly or materially effect the boiling point of the liquid hydrocarbons. Thus, hydrotreating, even mild hydrotreating is usually effected in the presence of a catalyst, such as supported Co/Mo, and some hydrocracking may occur. In the context of this invention, unprocessed virgin distillate includes virgin distillate subjected to mild hydrotreating which is defined as hydrotreating that does not materially change the boiling point of the liquid hydrocarbons and maintains sulfur levels of >10 ppm, preferably $\geqq 20$ ppm, more preferably $\geqq 30$ ppm, still more preferably $\geqq 50$ ppm. Thus, the forms of sulfur that act as oxidation inhibitors are not present in sufficient concentrations in the virgin distillate to provide inhibiting effects.

The result of this mixture is a distillate fraction, preferably a 250–700° F. fraction and more preferably a 320–700° F. that is both stable and resistant to oxidation. Oxidation stability is often determined as a build up of peroxides in the sample under consideration. While there is no standard for the peroxide content of fuels, there is general acceptance that stable fuels have a peroxide number of less than about 5, preferably less than about 4, and desirably less than about 1.

The Fischer-Tropsch process is well known and preferably utilizes a non-shifting catalyst such as cobalt or ruthenium or mixtures thereof, preferably cobalt, and more preferably a promoted cobalt, particularly where the promoter is rhenium. Such catalysts are well known and described in U.S. Pat. Nos. 4,568,663 and 5,545,674.

Non-shifting Fischer-Tropsch reactions are well known and may be characterized by conditions that minimize the formation of $CO_2$ by-products. These conditions can be achieved by a variety of methods, including one or more of the following: operating at relatively low CO partial pressures, that is, operating at hydrogen to CO ratios of at least about 1.7/1, preferably about 1.7/1 to 2.5/1, more preferably at least about 1.9/1 and in the range 1.9/1 to about 2.3/1, all with an alpha of at least about 0.88, preferably at least about 0.91; temperatures of about 175°–240° C., preferably about 180° C.–220° C., using catalysts comprising cobalt or ruthenium as the primary Fischer-Tropsch catalysis agent. A preferred process for conducting the Fischer-Tropsch process is described in U.S. Pat. No. 5,348,982.

The products of the Fischer-Tropsch process are primarily paraffinic hydrocarbons, although very small amounts of olefins, oxygenates, and aromatics may also be produced. Ruthenium catalysts produce paraffins primarily boiling in the distillate range, i.e., $C_{10}$–$C_{20}$; while cobalt catalysts generally produce more heavier hydrocarbons, e.g., $C_{20}$+.

The diesel fuels produced from Fischer-Tropsch materials generally have high cetane numbers, usually 50 or higher, preferably at least 60, and more preferably at least about 65.

Virgin distillates may vary in composition from field to field, but the virgin distillates will have some similar characteristics, such as: a boiling range of 250–700° F., preferably 320–700° F., derived from petroleum sources. Virgin middle distillates are always a mixture of paraffins, naphthene and aromatic hydrocarbons, as well as organic sulfur and nitrogen compounds. The exact amounts of each of these species is widely variable, but in most cases paraffins range from 20–70%, naphthas 10–40% and aromatic from 5–40%. Sulfur can range from a few hundred ppm to several percent.

The F-T derived middle distillate and the virgin middle distillate may be mixed in wide proportions, and as shown above, small fractions of virgin distillate can significantly effect the peroxide number of the blend. Thus, blends of 1–50 wt % virgin distillate with 99–50 wt % F-T derived distillate may readily be formed. Preferably, however, the virgin distillate is blended at levels of 1–40 wt % with the F-T derived distillate, more preferably 1–30 wt %.

The stable middle distillate blend of F-T derived distillate and virgin distillate may then be used as a fuel, e.g., diesel or jet, and preferably a fuel heavier than gasoline, or the blend may be used to upgrade or volume enhance petroleum based fuels. For example, a few percent of the blend can be added to a conventional petroleum based fuel for enhancing cetane number, typically 2–20%, preferably 5–15%, more preferably 5–10%; alternatively, greater amounts of the blend can be added to the petroleum based fuel to reduce sulfur content of the resulting blend, e.g., about 30–70%. Preferably, the blend of this invention is mixed with fuels having low cetane numbers, such as less than 50, preferably less than 45.

The blend of virgin distillate and Fischer-Tropsch distillate will preferably have a sulfur content of at least 2 ppm by weight; more preferably at least about 5 ppm, still more preferably at least about 15 ppm, still more preferably about ≧25 ppm, and yet more preferably ≧50 ppm. The blend may contain up to about 250 ppm S, preferably less than about 200 ppm S , more preferably less than 100 ppm S, still more preferably less than 50 ppm, and yet more preferably less than 30 ppm S.

Fischer-Tropsch derived distillates useful as fuels can be obtained in a variety of ways known to those skilled in the art, e.g., in accordance with the procedures shown in U.S. Pat. No. 5,689,031 or allowed U.S. application Ser. No. 798,376, filed.

Additionally, many papers have been published in which F/T derived distillate fuels are obtained by hydrotreating/hydroisomerizing all or appropriate fractions of Fischer-Tropsch process products and distilling the treated/isomerized product to the preferred distillate fraction.

Fischer-Tropsch distillates useful as fuels or fuel blending components are generally characterized as being:

>80 wt %, preferably >90 wt %, more preferably >95 wt % paraffins, having an iso/normal ratio of 0.1 to 10, preferably 0.3 to 3.0, more preferably 0.7 to 2.0; sulfur and nitrogen of less than 1 ppm each, preferably less than 0.5, more preferably less than 0.1 ppm each; ≦0.5 wt % unsaturates (olefins and aromatics), preferably ≦0.1 wt %; and less than 0.5 wt % oxygen on a water free basis, preferably less than about 0.3 wt % oxygen, more preferably less than 0.1 wt % oxygen and most preferably nil oxygen. (The F-T distillate is essentially free of acids.)

The iso paraffins of a F-T derived distillate are monomethyl branched, preferably primarily mono methyl branched and contain exceeding small amounts of cyclic paraffins, e.g., cyclo hexanes. Preferably, the cyclic paraffins of the F-T distillate are not readily detectable by standard methods, e.g., gas chromatography.

The following examples serve to illustrate but not limit the invention:

EXAMPLE 1

Stability of Fischer-Tropsch derived Distillate fuels: Blends with raw virgin distillate A Fischer-Tropsch fuel produced by the process described in U.S. Ser. No. 544,343) was distilled to a nominal 250–700° F. boiling point encompassing the distillate range. This material was tested according to a standard procedure for measuring the buildup of peroxides: First a 4 oz. sample was placed in a brown bottle and aerated for 3 minutes. An aliquot of the sample is then tested according to ASTM D3703-92 for peroxides. The sample is then capped and placed into a 60° C. oven for 1 week. After this time the peroxide number is repeated, and the sample is returned to the oven. The procedure continues each week until 4 weeks have elapsed and the final peroxide number is obtained. A value of <1 is considered a stable, distillate fuel.

This fuel was blended with a raw virgin distillate material in amount ranging from 0.1 to 25% to determine the effect on the final peroxide number. The data is shown in the Table I below

TABLE 1

| % F-T Fuel | % Virgin Condensate | Initial Peroxide # | Final Peroxide # | $S_1$ppm in Blend |
|---|---|---|---|---|
| 100 | 0 | 0 | 24.06 | 0 |
| 75 | 25 | 0 | 0.63 | 550 |
| 95 | 5 | 0 | 0.68 | 110 |
| 99 | 1 | 0 | 0.88 | 21 |
| 99.9 | 0.1 | 0 | 13.17 | 2 |
| 0 | 100 | 0 | 0 | 2100 |

There is a significant effect of 0.01% of the raw virgin distillate which reduced the peroxide number close to 50%, occurring at a sulfur level of only 2 ppm in the blend (2100 ppm in the raw virgin distillate neat).

EXAMPLE 2

Stability of Fischer-Tropsch derived Distillate fuels: Blends with hydrotreated virgin distillate A Fischer-Tropsch fuel produced by the same (as in example 1) was distilled to a nominal 250–700° F. boiling point encompassing the distillate range. This material was tested according to a standard procedure as described in Example 1.

This fuel was blended with a virgin distillate material which had been conventionally hydrotreated to 290 ppm S. Blends were in amounts ranging from 0.1 to 25% to determine the effect on the final peroxide number. The data is shown in Table 2, below:

TABLE 2

| % F-T Fuel | % Virgin Distillate | Initial Peroxide # | Final Peroxide # | $S_1$ppm in Blend |
|---|---|---|---|---|
| 100 | 0 | 0 | 24.06 | 0 |
| 75 | 25 | 0 | 0.84 | 73 |
| 95 | 5 | 0 | 3.87 | 15 |
| 99 | 1 | 0 | 9.47 | 3 |
| 99.9 | 0.1 | 0 | 25.26 | 0.3 |
| 0 | 100 | 0 | 0 | 290 |

As in Example, 1, a significant benefit can be obtained at low sulfur concentrations. At a concentration of only 1% virgin distillate (3 ppm S in the blend), the buildup of peroxides is reduced 61%. In another test, at 0.3 ppm S or 0.1% hydrotreated condensate there is no significant effect, and the results for the neat F-T fuel are reproduced to within 5%.

These results indicate that a virgin distillate stream blended with an F-T fuel has at least 2 ppm S in the final blend will substantially inhibit peroxide growth in the final fuel. The virgin distillate may be hydrotreated to remove 90% or more of the original S in the petroleum and still function effectively.

We claim:

1. A blend material useful as a distillate fuel or as a blending component for a distillate fuel comprising (a) a Fischer-Tropsch derived distillate comprising a $C_8$–700° F. stream comprised 250–700° F. fraction and having a sulfur content of less than 1 ppm by wt, and (b) 1–40 wt % of a virgin distillate comprising a $C_8$–700° F. stream comprised of 250–700° F. fraction; wherein the sulfur content of the blend material is ≧2 ppm by wt.

2. The blend material of claim 1 wherein the virgin distillate is selected from the group consisting of raw virgin distillate and mildly hydrotreated virgin distillate where the boiling range of the distillate is not materially changed.

3. The blend material of claim 2 wherein the sulfur content of the virgin distillate is ≧10 ppm.

4. The blend material of claim 2 wherein the proportion of (b) in the blend ranges from about 1–30%.

5. The blend material of claim 2 further blended with a petroleum derived distillate.

6. The further blend of claim 5 wherein the blend material is about 30–70% of the further blend.

* * * * *